United States Patent [19]

Mulligan

[11] Patent Number: 4,759,082

[45] Date of Patent: Jul. 26, 1988

[54] GARMENT FOR SMALL CHILDREN

[76] Inventor: Mark Mulligan, 3653 Perry Ave. N., Robbinsdale, Minn. 55422

[21] Appl. No.: 945,631

[22] Filed: Dec. 23, 1986

[51] Int. Cl.[4] ..... A41D 11/00

[52] U.S. Cl. ..... 2/69.5; 2/75

[58] Field of Search ..... 2/69.5, 78, 80, 79, 2/75

[56] References Cited

U.S. PATENT DOCUMENTS

| | | | |
|---|---|---|---|
| 2,234,546 | 3/1941 | Basch | 2/69.5 |
| 2,579,276 | 12/1951 | Schworm, Jr. | 2/69.5 |
| 2,598,462 | 5/1952 | Strauss | 2/69.5 |
| 4,125,910 | 11/1978 | Nicholai | 2/69.5 |
| 4,236,263 | 12/1980 | Allee | 2/69.5 X |
| 4,507,805 | 4/1985 | Calutoiu | 2/69.5 |

FOREIGN PATENT DOCUMENTS

| | | | |
|---|---|---|---|
| 1222262 | 1/1960 | France | 2/69.5 |

*Primary Examiner*—Peter Nerbun

*Attorney, Agent, or Firm*—Cullen, Sloman, Cantor, Grauer, Scott & Rutherford

[57] ABSTRACT

A garment which may be worn by the user, especially by infants and small children, as daywear and sleepwear. The garment has a body portion which is capable of enclosing at least the torso of the user. A plurality of openings are located about the body portion to accommodate the extremities and head of the user. The body portion is dimensioned such that selected extremities and the head of the user may be easily and completely withdrawn within the body portion, so that the user may attain a snuggling mode. The garment may further include a pillow portion secured to the body portion adjacent the opening for the head of the user to rest upon when reclining. In an alternative embodiment for newborn infants, the opening for the legs is wider and includes a draw string for a closure.

10 Claims, 1 Drawing Sheet

GARMENT FOR SMALL CHILDREN

FIELD AND BACKGROUND OF THE INVENTION

The present invention relates to a garment and particularly to a garment for infants and small children, one aspect of which is that it may be worn as active daywear and may also be worn as sleepwear to enclose the body of the user for retaining the heat radiated therefrom.

Sleepwear garments for infants and small children are well-known in the art, such items generally being inappropriate for wear during periods of play or other types of activity, except for sleeper type pajamas which do not allow the child to readily adjust his comfort needs. When the child wished to rest or because of fatigue fell asleep, his garments required changing to meet the varying situations. This usually required disturbing him. Also, once the child had been changed and put to rest, he required covering. During this rest period, it was not uncommon for the child to throw his coverings off and/or to become entangled in them. Further, sleeping bag-like items were available in which a child could rest. However, they unduly restricted mobility and did not allow the child to adjust his comfort needs. This was especially true in situations where such items were used by older and more mobile or active children.

Thus, there has been a need for a garment which could be worn by infants and small children during daytime and also worn during resting periods without requiring changing from one type of garment to another. In addition, such a garment when worn during active periods should not unduly restrict the mobility of the user. Also, such a garment should be capable of allowing users to vary exposure to adjust or meet their comfort needs, particularly older children.

SUMMARY OF THE INVENTION

The invention herein contemplates a garment to be worn by the user, especially infants and small children, as active daywear and as sleepwear to enclose the body for retaining the heat radiated therefrom. The garment includes a body portion having a top, a bottom and at least two major sides. The body portion is capable of enclosing at least the torso of the user, and it has a plurality of extremity openings situated about the body portion to accommodate the extremities of the user. These openings include first and second openings to provide access for the arms and a third opening to provide access for at least one leg. Thus, a user being situated within the body portion may extend any number of extremities through the appropriate openings to provide the user with the desired degree of mobility. A fourth opening is located at the top of the body portion to provide access for the head of the user. The body portion is dimensioned such that the extremities of the user may be selectively and completely withdrawn within the body portion to attain a snuggling mode, yet the openings permit the extremities to be exposed as desired for mobility. In addition, a pillow portion may be secured to the body portion adjacent the fourth opening, so that the user may rest his head upon it when reclining.

In an alternative embodiment especially for newborn infants, who require little mobility, the opening for the legs may be widened and include a draw string.

DESCRIPTION OF THE DRAWINGS

The various features, objects, benefits, and advantages of the present invention will become more apparent by reading the following detailed description in conjunction with the drawings where like reference numerals identify corresponding components, and.

DETAILED DESCRIPTION OF THE PREFERRED EMBODIMENT

Figure 1:
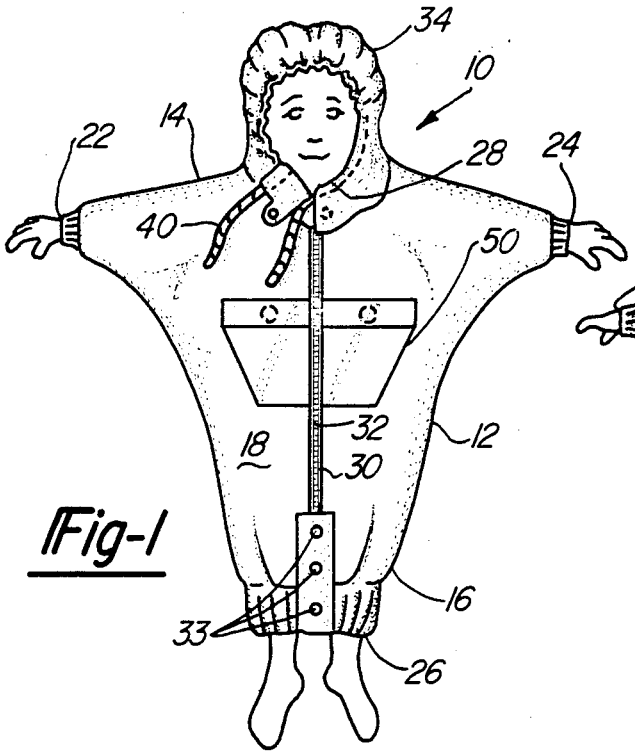
FIG. 1 is a front view of the garment of the present invention demonstrating the positioning of the user relative to the garment in an active mode.
Figure 2:
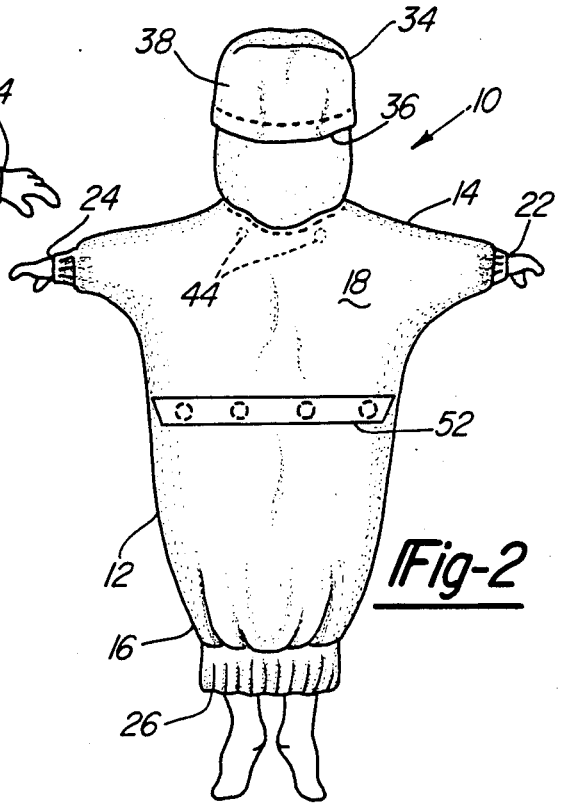
FIG. 2 is a back view of the garment.

Referring to FIGS. 1 and 2, the garment of the present invention, generally designated 10, is illustrated as worn in an active mode. The garment includes a body portion 12 having a top 14, a bottom 16 and two major sides 18. The body portion is of sufficient size to enclose at least the torso of the user.

The particular material or fabric of which the body portion 12 is constructed is not essential to the present invention. However, fire retardant and non-toxic fabrics are particularly appropriate because the garment may be worn by infants and small children. It has been found that such a fabric may be sewn or otherwise fastened about its peripheral edge to form the body portion. In addition, the material may be quilted with an insulating material such as Thinsulate ("Thinsulate" is a trademark of Minnesota Mining and Manufacturing Company of St. Paul, Minn.) sewn between two layers of fabric to provide additional warmth.

The body portion includes a plurality of openings situated about it to accommodate the extremities of the user. Specifically, these openings include a first opening 22 and a second opening 24 to provide access for the arms, and a third opening 26 to provide access for at least one leg. In the preferred embodiment only three openings are provided, so that both legs must use the third opening 26. It has been found that it is much easier to freely extend or withdraw both legs from a single large opening than from two small openings. If the legs are only extended through the third opening to at least crotch level, the greatest amount of the user is covered while permitting a reasonable degree of mobility. Thus, a user may even run to some limited extent when wearing the garment. Some degree of elasticity may be desired at the perimeter of the openings 22, 24 and 26 for increased comfort and warmth in the snuggling mode without loss of mobility. Also, this ensures that the garment will remain in place when pulled about the extremities for added mobility. This is especially important when the garment is pulled above knee level to further expose the legs.

A fourth opening 28 is provided at the top 14 of the body portion 12 to provide access for the head. A draw string or the like may extend around the opening to enable the user to increase or decrease the size of the opening if desired.

In addition, a fifth opening 30 is located along at least one side 18 of the body portion 12 to permit the garment to be put on and removed. The fifth opening includes a closure such as, for example, a zipper 32, whereby the opening may be selectively closed or opened. Also, Velcro, snaps, buttons and the like may be used. The particular closure is not essential to the present invention. In the illustrated embodiment, a plurality of snaps 33 are provided along the bottom of the zipper 32.

Figure 3:
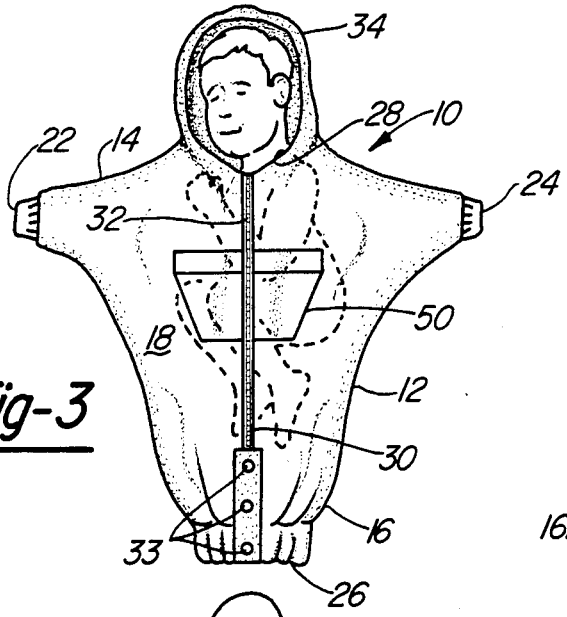
FIG. 3 is a front view of the garment demonstrating the positioning of the user relative to the garment during a snuggling mode.
Figure 4:
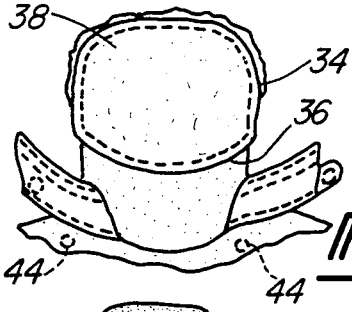
FIG. 4 is an enlarged, fragmentary view of the back of the garment illustrating the details of the pillow portion.
Figure 5:
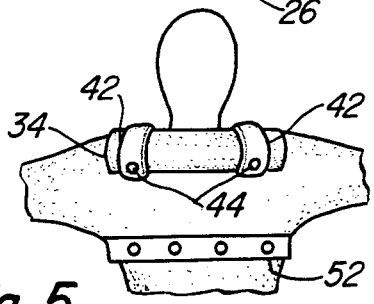
FIG. 5 is a back view of the garment illustrating the securement of the pillow portion when not in use.

As illustrated in FIGS. 1, 2 and 3, and in greater detail in FIG. 4, a pillow portion 34 is secured adjacent the fourth opening 28. Thus, when the child is reclining, whether on a bed, couch, chair or floor, he may rest his head thereupon as illustrated in FIG. 3. The pillow portion 34 may be contoured to provide proper support for the neck. In the preferred embodiment, as illustrated in FIGS. 2 and 4, a pouch 36 is provided in which a pillow of foam 38 may be inserted. Also, it should be appreciated that the pillow portion may be separate and detachably secured to the body portion 12 by a zipper, Velcro, buttons and the like. Detachability of the pillow portion allows for ease of laundering of the garment. In addition, the pillow portion 34 may be formed so as to be used as a hood with a draw string 40 around the opening as illustrated in FIG. 1. Also, when not in use, the pillow portion 34 may be rolled up and secured to the garment by flaps 42 and snaps 44, as illustrated in FIGS. 4 and 5.

In the preferred embodiment, as best illustrated in FIGS. 1 and 3, at least one pocket 50 may be sewn along the outer surface of one side 18 for storing various items. In addition, at least one pocket 52 may be sewn or otherwise formed along the outer surface of the other side, as illustrated in FIGS. 2 and 5. By way of example, when the garment is worn by infants, towels, diapers, pacifiers and even bottles may be secured in the pockets and easily obtained by a parent to be given or used by the infant. This is particularly handy when the infant is carried about in the garment. Zippers, buttons or the like may be used as closures for the pockets 50 and 52, so that the infant may not get the items on his own without an adult or older child opening the pocket. In addition, the pockets may be divided into a plurality of compartments.

Figure 6:
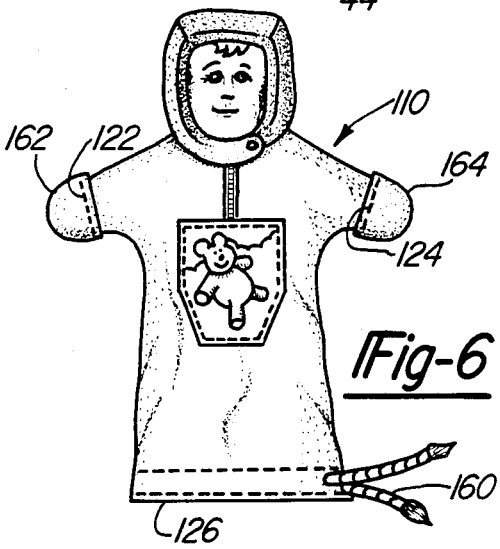
FIG. 6 is a front view of an alternative embodiment of the garment for use by newborn infants.

In an alternative embodiment, as illustrated in FIG. 6, a garment 110 includes a wide third opening 126 and a draw string 160 as a closure for the opening. This allows the garment 110 to be more easily worn by newborn infants who require very little mobility. In addition, the garment 110 may be pulled up over the infant to permit changing. Further, the garment 110 may include two openings 122 and 124 and two mitten-like coverings 162 and 164 attached near the openings for covering the hands of the infant when extended through the openings.

The size and dimensions of the garment should be such that it is non-formfitting. This is essential to the present invention in order to ensure that the extremities and, if desired, the head of the user may be easily and completely withdrawn within the upper portion of the body portion 12 to attain the snuggling mode illustrated in FIG. 3. It has been found that when the body portion has a generally V-shaped configuration narrowing at the bottom 14, the body portion will drape about the user, as illustrated in FIG. 1, without being unduly cumbersome and allow selective withdrawal of the extremities, particularly the arms. Thus, the width of the garment selected for a particular child should not be so large that it covers the hands when the arms are fully extended. This also allows for ease of extension of the arms and legs because they are funneled towards the appropriate opening.

USE OF THE PRESENT INVENTION

When the garment 10 is worn, users may selectively withdraw or extend their arms and legs to increase their comfort level if they become too hot or too cold, or require a greater degree of mobility. In addition, if users wish to recline or rest while wearing the garment, they may rest their heads upon the easily accessible pillow portion 34 secured adjacent the fourth opening 28.

While a preferred embodiment of the present invention has been described so as to enable one skilled in the art to practice the techniques of the present invention, the preceding description is intended to be exemplary and should not be used to limit the scope of the invention. The scope of the invention should be determined only by reference to the following claims.

I claim:

1. A garment which may be worn by a user, particularly infants and small children, as daywear and sleepwear, comprising:

a body portion having a top, a bottom and at least two major sides, said body portion being capable of enclosing at least the torso of the user;

said body portion having a plurality of extremity openings situated about the body portion to accommodate the extremities of said user, specifically first and second openings to provide access for the arms of said user and a third opening to provide access for at least one of the legs of said user, whereby the user being situated within said body portion may selectively extend any number of extremities through the appropriate openings to provide said user with the desired degree of mobility;

a fourth opening being located at the top of said body portion to provide access for the head of said user, whereby the head of said user may extend therefrom; and said body portion having a continuous side edge extending from the first opening towards the third opening and a continuous side edge extending from the second opening towards the third opening thereby forming a generally V-shaped configuration narrowing at the bottom so that when the arms of said user are fully extended outward, the body portion will drape about said user and the arms of said user may be covered by said body portion while the hands of said user may be exposed, whereby selected extremities of the user may be easily and completely withdrawn within an upper portion of said body portion to attain a snuggling mode and selected extremities of the user may be easily extended toward and through the appropriate opening to provide mobility.

2. The garment defined in claim 1, wherein both of the legs of the user may extend through said third opening to crotch level.

3. The garment defined in claim 1, further comprising pocket means associated with said body portion for holding various items.

4. The garment defined in claim 1, further comprising yieldable contracting means associated with said extremity openings for snuggling engagement with the extremities of said user extending therefrom.

5. The garment defined in claim 1, further comprising yieldable contracting means associated with said extremity openings for snugging engagement with the extremities of said user extending therefrom.

6. The garment defined in claim 1, further comprising access opening means located along at least one side of said body portion for allowing the garment to be worn and removed by said user.

7. The garment defined in claim 6, further comprising closure means associated with said access opening means for selectively closing and opening said access opening means.

8. The garment defined in claim 1, further comprising a pillow portion secured to said body portion adjacent the fourth opening so that when the head of the user is extended through the fourth opening and the user is reclined the head may rest thereupon.

9. The garment defined in claim 8, wherein said pillow portion is detachably secured adjacent said fourth opening.

10. A garment which may be worn by a user, particularly infants and small children, as daywear and sleepwear, comprising:

a body portion having a top, a bottom and at least two major sides, said body portion being capable of enclosing at least the torso of the user;

said body portion having a plurality of extremity openings situated about the body portion to accommodate the extremities of the user, specifically first and second openings to provide access for the arms of said user and a third opening to provide access for the legs of said user, whereby said user being situated within said body portion may extend any number of extremities through the appropriate opening with the legs of said user extendable through said third opening to crotch level to provide said user with the desired degree of mobility;

a fourth opening being located at the top of said body portion to provide access for the head of the user, whereby the head of said user may extend therefrom; and said body portion including a continuous side edge extending from the first opening towards the third opening and a continuous side edge extending from the second opening towards the third opening with said body portion being dimensioned such as to have a generally V-shaped configuration narrowing at the bottom whereby when the arms of said user are fully extended outward, the body portion will drape about said user and the arms of said user may be covered by said body portion and the hands of said user may be exposed so that selected extremities of the user may be easily and completely withdrawn within an upper portion of said body portion to attain a snuggling mode;

yieldable contracting means associated with at least the first, second and third openings for snuggling engagement with the extremities of said user extending therefrom;

access opening means located along at least one side of said body portion for allowing the garment to be put on or taken off by said user;

closure means associated with said access opening means for selectively closing and opening said access opening means;

a pillow portion secured to said body portion adjacent said fourth opening so that when the head of the user is extended through the fourth opening and the user is reclined, the head may rest thereupon;

wherein when extending selected extremities of the user, such extremities are funneled towards the appropriate opening for ease of extension to provide mobility to the user.

* * * * *